US007975577B2

(12) United States Patent
Pfab

(10) Patent No.: US 7,975,577 B2
(45) Date of Patent: Jul. 12, 2011

(54) SELF-OPENING HAND TOOL

(75) Inventor: Stefan Pfab, Neustadt (DE)

(73) Assignee: Will Werkzeuge GmbH & Co. KG, Neustadt (DE)

( * ) Notice: Subject to any disclaimer, the term of this patent is extended or adjusted under 35 U.S.C. 154(b) by 156 days.

(21) Appl. No.: 12/226,074

(22) PCT Filed: Apr. 16, 2007

(86) PCT No.: PCT/EP2007/053668

§ 371 (c)(1),
(2), (4) Date: Oct. 7, 2008

(87) PCT Pub. No.: WO2007/118868

PCT Pub. Date: Oct. 25, 2007

(65) Prior Publication Data

US 2009/0293686 A1 Dec. 3, 2009

(30) Foreign Application Priority Data

Apr. 18, 2006 (DE) ..... 20 2006 006 159 U
Oct. 25, 2006 (DE) ..... 10 2006 050 133

(51) Int. Cl.
*B25B 7/00* (2006.01)
*B26B 13/00* (2006.01)

(52) U.S. Cl. ..... 81/417; 30/261

(58) Field of Classification Search ..... 81/417, 81/381, 416; 30/261, 268, 271, 363
See application file for complete search history.

(56) References Cited

U.S. PATENT DOCUMENTS

| | | | | |
|---|---|---|---|---|
| 81,717 | A * | 9/1868 | Weston | 30/363 |
| 3,458,933 | A * | 8/1969 | Rogers | 30/261 |
| 6,263,770 | B1 | 7/2001 | Gomas et al. | |
| 6,941,845 | B2 * | 9/2005 | Hsien | 81/417 |
| 7,143,672 | B1 * | 12/2006 | Di Bitonto et al. | 81/417 |

FOREIGN PATENT DOCUMENTS

| | | |
|---|---|---|
| DE | 75 08 863 | 10/1976 |
| DE | 299 05 897 | 7/1999 |
| DE | 10 2004 024 385 | 12/2004 |
| FR | 2 765 134 | 12/1998 |
| FR | 2 855 087 | 11/2004 |

OTHER PUBLICATIONS

International Search Report.

* cited by examiner

*Primary Examiner* — David B Thomas
(74) *Attorney, Agent, or Firm* — Collard & Roe, P.C.

(57) ABSTRACT

The invention relates to a self-opening hand tool (1) with two tool halves (2, 3) that cross over each other at a joint (4), in particular in the form of a pair of pliers, scissors or the like, with one half of the tool (2, 3) forming a jaw (5) on one side of the joint (4) and a handle (6) on the other side of the joint (4), with a spring element (8) of elastically deformable rubber or plastic material also associated with a handle (6), which has an opening (9) through which the handle (6) passes, and that can be moved into at least one operating position at will by turning it from a non-operating position, in which operating position the spring element (8) contacts the opposite handle (6) depending on the spread angle of the handle (6) and the generation of the appropriate restoring force. To further improve the initially described hand tool for more advantageous use, it is recommended that the handle (6) be contained in a handle case and that the spring element (8) be supported by a form fit to maintain the operating position or the non-operating position.

27 Claims, 8 Drawing Sheets

SELF-OPENING HAND TOOL

CROSS REFERENCE TO RELATED APPLICATIONS

This application is the National Stage of PCT/EP2007/053668 filed on Apr. 16, 2007, which claims priority under 35 U.S.C. §119 of German Application No. 20 2006 006 159.2 filed on Apr. 18, 2006 and German Application No. 10 2006 050 133.0 filed Oct. 25, 2006. The international application under PCT article 21(2) was not published in English.

The invention relates, in first instance, to a hand tool having two tool halves which cross over at a joint, in particular a hand tool in the form of pliers, scissors or the like, it being the case that a tool half forms a jaw on one side of the joint and forms a handle on the other side of the joint, and also that a spring element is associated with one handle, the spring element consisting of an elastic deformable rubber or plastics material and having an opening through which the handle passes, and it being the case that the spring element can be moved optionally, by rotation, out of an inactive position into at least one active position, in which active position the spring element, in dependence on the extent to which the handles spread apart and on a corresponding restoring force being generated, comes into contact with the handle located opposite.

A hand tool of the generic type in the form of a pair of pliers is known, for example, from German Utility Model 75 08 863. The opening in the spring element has a round cross-section. The round opening means that the individual positions of the spring element are not precisely defined. This may result in undesired displacement of the spring element. The spring element consists of an elastic material and is retained on the handle of the pliers exclusively by the resultant retaining force of the elastic material.

It is an object of the invention to develop in a functionally advantageous manner a hand tool described in the introduction.

This object is achieved first and foremost in the case of a hand tool having the features of claim 1, this being based on the fact that the handle is accommodated in a handle enclosure, and that a positive fit assists in an active position or inactive position of the spring element being maintained.

A hand tool configured in this way is functionally advantageous for the user in respect of handling since the spring element is retained in the respective position by a positive fit and a handle enclosure, which is usually secured in captive fashion on the corresponding portion of the tool half, allows the spring element, at the same time, to be reliably secured on the tool half, for example by a joint-side edge of the handle enclosure being used in order to secure the spring element on the tool half. Furthermore, it is advantageously possible for the advantages which are associated anyway with such a handle enclosure (insulation, handle contour, etc.) also to be used in combination with a spring element such as that described here. As a result of the positive fit, undesired rotation of the spring element during use of the hand tool is usually not a problem. Furthermore, the spring element may also be configured so that it can be disposed, in different active positions, with a positive fit in relation to the handle located opposite, which correspondingly results in different spring characteristics and/or different opening angles between the jaws when the spring is released from loading. The positive fit may be provided both between the spring element and the handle and between the spring element and the handle enclosure, and also in the form of latching, for example latching in the region of the opening in the spring element or latching in conjunction with a flat side of the spring element and of the handle enclosure. It is possible to provide a number of latching positions, preferably associated with different active positions of the spring.

A description will be given hereinbelow of features which are important preferably in combination with the features of claim 1, but, in principle, may also be important with the combination of just some of the features of claim 1 or in their own right.

It is thus also provided, in particular, that the handle enclosure passes through the opening in the spring element. The spring element is thus seated on the handle enclosure. The positive fit is provided here between the spring element and the handle enclosure. Since the handle enclosure passes through the spring element, it is also possible to maintain the customary insulation protection of the handle enclosure. It is ensured that the corresponding portion of the tool half is fully covered over by insulating plastics material.

It is further preferred, in order to achieve the positive fit—as seen over the respective length—for the handle or the handle enclosure to be of non-round configuration in cross-section and for the opening in the spring element to be cross-sectionally adapted in shape to the portion of the handle or of the handle enclosure. The non-round cross-section is, in particular, a polygon, for example a cross-section approximating to a square. The corners may be rounded in a manner appropriate for the material used. In contrast to this, the cross-section may also be one which approximates to a pentagon, hexagon, octagon or the like. The cross-section may also be oval. The cross-section is preferably selected such that the different active positions and inactive position are assumed, and retained, in a stable manner, but manual adjustment is still nevertheless readily possible.

The spring element is preferably disposed on the joint side of a supporting shoulder formed on the handle enclosure. Even in the case where the spring element has the handle enclosure passing through it, the spring element is prevented from sliding off. The spring element is held captive between the supporting shoulder and the joint. Furthermore, the supporting shoulder is preferably adapted in shape to the outline of the spring element in the inactive position. In the inactive position, the handle enclosure combined with the spring element thus corresponds to the conventional handle enclosure, it being the case that the joint-side thickened portion, which is intended to prevent the hand from sliding off in the direction of the joint, is of thickened form. To this extent, the handle enclosures of the two tool halves are then also formed differently.

The handle enclosure, which passes through the spring element, preferably forms a shoulder on the joint side of the spring element—in a suitable manner: in addition, that is to say in addition to the supporting shoulder which has already been described. This means that it is not possible for the spring element to be displaced over the shoulder in the direction of the joint, which could be troublesome. It is possible to maintain a defined spacing between the spring element and the joint. The spring element—possibly secured by the shoulder—is suitably spaced apart from the outer contour of the joint. The spacing may correspond to one to four times, preferably one to two times, the thickness of the spring element as seen in the axial direction of the tool half or of the handle enclosure. The spacing dimension preferably corresponds to one and a half times the thickness of the spring element. It is also possible, in principle, for the spring element to be disposed between the shoulder and the supporting shoulder such that it can be displaced in the axial direction of the handle enclosure, for example in order thereby to achieve, in addition, a further variation of the active positions. An axially non-displaceable arrangement, however, is preferred.

The shoulder preferably has a smaller outline than the supporting shoulder, this being in keeping with its function, predominantly just that of securing the spring element axially. In addition, this makes it possible to achieve an exposed activation surface of the spring element (broad side, joint side), and this surface can also be used for actuating the spring element. The smaller outline of the shoulder is also advantageous in the sense that the spring element can be guided over the shoulder—with elastic widening—for fitting purposes (and only then, if appropriate, can the thus combined handle enclosure be pushed onto the tool half).

In more specific terms, the spring element is preferably geometrically configured such that the geometry gives rise to certain spring characteristics, or spring characteristics which differ over the circumference and are associated with individual active positions. It is thus preferred to provide at least one cavity in the spring element. This cavity—preferably in the form of a cut-out which passes all the way through—is located in the active region of the spring element. The specific configuration of the cavities makes it possible to set the spring action of the spring element as desired. The cavity, which preferably extends in the direction of the thickness of the spring element, may also merge into the opening which is already present. It may be a large cavity, or it is also possible for a multiplicity of small cavities to be formed in the spring element. It is also possible for the cavities to pass only part of the way through the spring element.

The spring element preferably consists of a rubber material or a thermoplastic elastomer. A polyurethane or polypropylene elastomer is recommended (PPEPDM). The Shore A Hardness is preferably in the region of 50 to 80, further preferably between 60 and 70.

The spring element may also be produced from a combination of two or more materials, which then suitably have different degrees of hardness. It is thus advantageous, for example, for regions of the spring element which, for adjustment into the various active positions, are activated by hand, to be formed by a harder material, but for the actual spring regions to be formed from a softer material. It is also possible, however, for the abovementioned combination of materials to be used in order to set the spring characteristics.

In order to assist handling in an advantageous manner, it may be provided for grip hollows to be formed on the spring element. Within the context of the above explanation, these may consist of a harder material when, for example, the spring element is produced overall by two-component injection molding. It is also possible, not least, for the different materials to be used to establish coloring.

The extent of the opening in the spring element as seen in the direction of action of the spring element is preferably greater than the thickness dimension of the spring element along the axial extent of the tool half or of the handle enclosure. The size of the opening preferably corresponds to 1.2 to 4 times the abovementioned thickness dimension of the spring element, further preferably 1.2 to 2 times and more preferably 1.5 times.

The invention also relates to a hand tool having two tool halves which cross over at a joint, in particular a hand tool in the form of pliers, scissors or the like, it being the case that a tool half forms a jaw on one side of the joint and forms a handle, enclosed by a handle enclosure, on the other side of the joint, and also that a spring element is associated with an inner side of one handle enclosure, which spring element, by displacement towards the joint in the direction of the longitudinal extent of the handle enclosure, can be moved from an inactive position, in which the spring element is supported by the back of the handle, into at least one active position, in which active position the spring element, in dependence on the extent to which the handles are spread apart and on a corresponding restoring force being generated, comes into contact with the handle located opposite.

Such a hand tool in the form of a set of pliers is known, for example, from DE 10 2004 024 385 A1. In the case of these pliers, the spring element is formed from a metallic lamella which is guided between the handle and the handle enclosure. The lamella has a predetermined curvature, and this curvature, in the inactive position, is forced back to a pronounced extent under elastic deformation, and thus constant prestressing. By virtue of the lamella being displaced into its active position, the lamella, in the first instance, resumes its predetermined level of curvature, with stressing being relieved to an increasing extent, as a result of which a freely projecting end of the lamella ends up spaced apart to a considerable extent from the handle or the handle enclosure. When the pliers are used, this free end is displaced in the direction of the handle, with corresponding elastic deformation and a restoring force being built up in the process.

Taking the abovedescribed prior art as the departure point, it is an object of the invention to provide an advantageous hand tool with a spring element which can be moved into an active or inactive position by displacement in the longitudinal direction of the tool half.

This object is achieved first and foremost in the case of the subject matter of claim 17, this being based on the fact that the spring element, even in the active position, is supported by the back of the handle or of the handle enclosure. Elastic deformation of the spring element during displacement is no longer necessary. The spring element need not be retained with prestressing in the inactive position. The displacement is not influenced by forces which are based on elastic prestressing of the spring element. A straightforward and advantageous construction is possible overall.

It is also the case for this embodiment that the spring element preferably consists of an elastic deformable rubber or plastics material. Reference is made to what has been said above in this respect.

The spring element itself has an active portion and a slide portion. The slide portion is preferably provided with laterally formed longitudinal grooves, in which guide rails of the handle enclosure engage. By means of the slide portion and of the handle enclosure, specifically the abovementioned guide rails of the handle enclosure, the spring element is guided in the longitudinal direction of the handle enclosure or of the tool half. The spring element is connected to the handle enclosure in a positively fitting manner.

The slide portion preferably has a width which corresponds to more than half the width of the tool half or of the handle in this region, preferably approximately 4/10 to 9/10 of the width mentioned.

In the region of the slide portion, the spring element further preferably forms a finger-supporting portion. This is the back region of the slide, which is exposed in the inward direction and is directed toward the other tool half. The active spring-element portion, which is preferably of ball-like form at the front—as seen in the direction of the joint—and as a result of which the spring element is considerably thicker in the region of the active portion than in the region of the finger-supporting portion, thus provides an actuating surface which allows the spring element to be displaced straightforwardly, for example, by the thumb. The relatively large active portion also, at the same time, provides an abutment for the thumb in the forward direction. It is also possible to provide, in the rearward direction, a bead against which the thumb, which is mentioned by way of example, can also end up in positively fitting abutment when the spring element is moved back. The width of the spring element means that the thumb usually does not come into contact with the inner side of the handle enclosure, so that the displacement is not adversely affected by this factor either.

It is also the case that this spring element further preferably has one or more openings in the active portion. The active portion, which is raised in relation to the slide portion, may be configured by means of the opening so as to give a slipper-like configuration. This opening may also preferably be in the form of a through-opening.

In addition, it is also preferred, in respect of this embodiment, if the handle enclosure also provides for the handle to be fully enclosed in the region of the spring element.

Furthermore, it is also possible for this spring element to consist of a number of materials, possibly of different degrees of hardness. In particular, it may even be produced by two-component injection molding. It is recommended here for in particular the region of sliding interaction with the handle enclosure to be produced from a relatively hard material and for the active portion, in contrast, to be produced from a relatively soft material. If appropriate, it is also possible for the exposed back of the slide portion, this forming the finger-supporting portion, to be formed from a relatively soft material, in order thus to allow more advantageous handling.

The invention is explained further hereinbelow with reference to the accompanying drawing, which however merely illustrates exemplary embodiments and in which.

Figure 1:
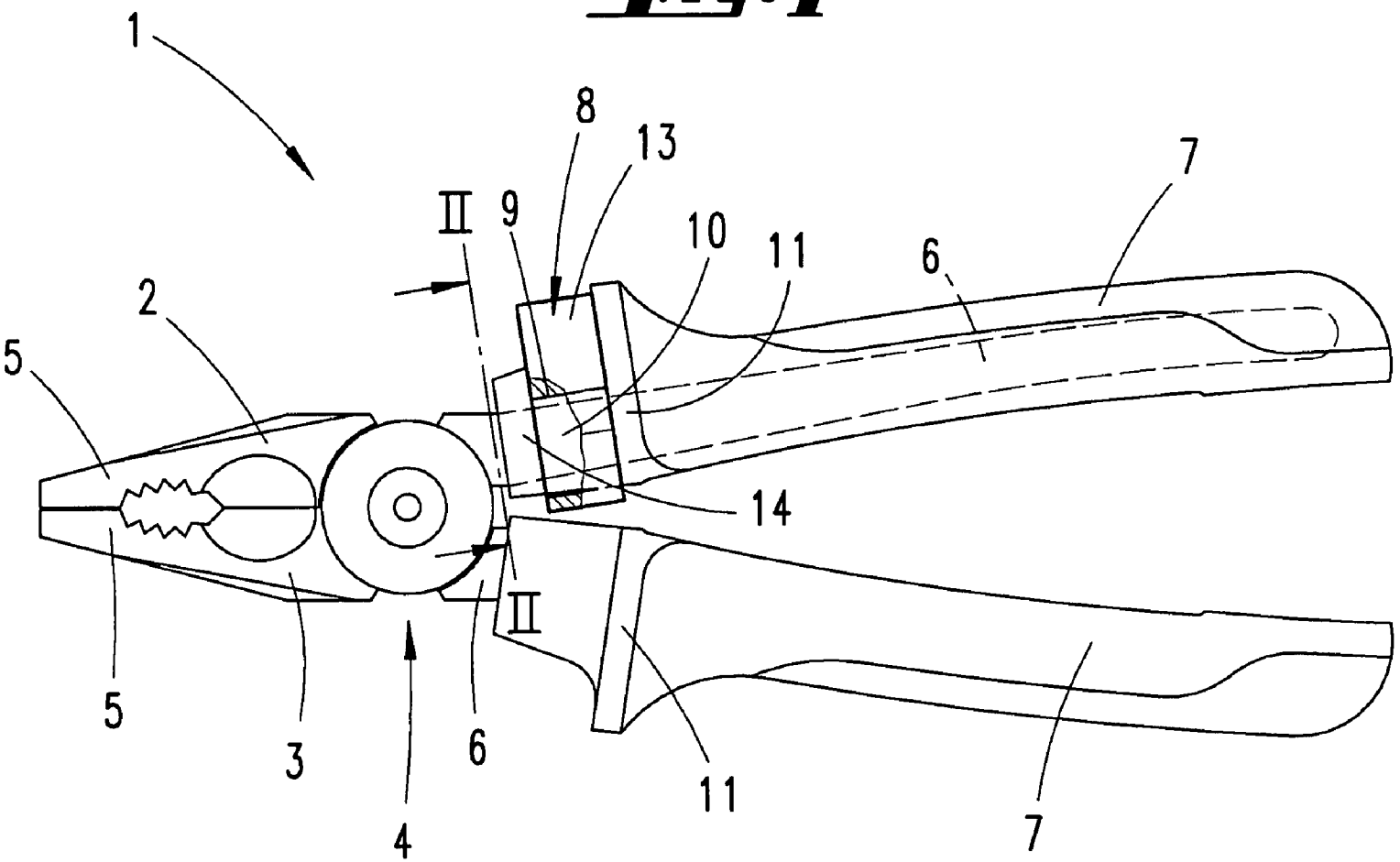
FIG. 1 shows the front view of a first exemplary embodiment of a hand tool in the form of multi-purpose pliers, with the spring element in the inactive position, the hand tool being in a closed position.

A first exemplary embodiment of a hand tool 1 in the form of multi-purpose pliers is illustrated and described with reference to FIGS. 1 to 5. The hand tool 1 is formed by two tool halves 2, 3 which are connected to one another by means of a joint 4. Each tool half 2, 3 forms a respective jaw 5 and a handle 6. The two handles 6 are accommodated in each case in a handle enclosure 7. The handle enclosure 7 forms a supporting shoulder 11 in its joint end region. In the case of one of the two handle enclosures 7, a spring element 8 is disposed on the joint side of the supporting shoulder 11. The spring element 8 consists of an elastic rubber or plastics material. Furthermore, the spring element 8 forms an opening 9 with a cross-section which approximates to a square cross-section. This opening 9 has a portion 10 of the handle enclosure 7 engaging though it, and this portion has a cross-section adapted to the shape of the opening 9. The length of the portion 10 is adapted to the thickness of the spring element 8. The thickness of the spring element 8 corresponds to 0.5 to 2 times, preferably approximately 1.5 times, the thickness of the handle 6 in the region of the spring element 8.

Figure 2:
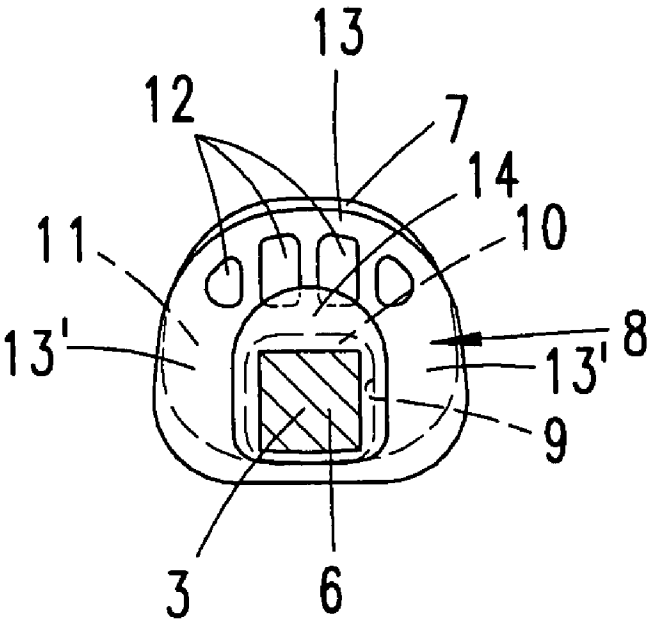
FIG. 2 shows a section according to line II-II from FIG. 1.

As can be gathered, in particular, from FIG. 2, which represents the inactive position, the outline of the spring element 8 in this position is adapted in shape more or less to the outline of the supporting shoulder 11.

The spring element 8 also has a plurality of cavities 12, separated from one another by means of crosspieces, in an active region 13. The shoulder 14 has a smaller outline than the supporting shoulder 11. The outline of the shoulder 14 is dimensioned such that the spring element 8 can be fitted onto the portion 10, over the shoulder 14, by virtue of the opening 9 being widened elastically. This shoulder 14 thus overlaps only a small surface area of the spring element 8 for axial securing purposes.

Figure 3:
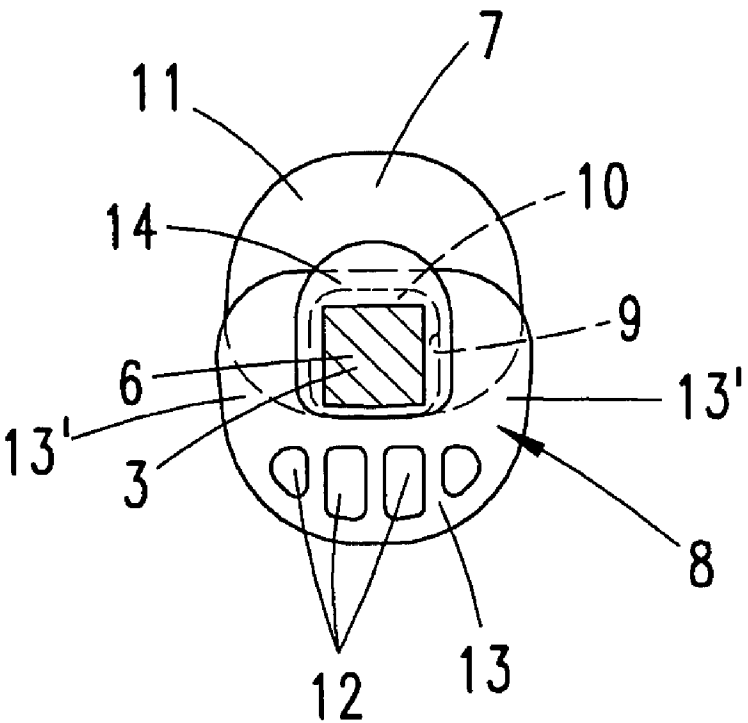
FIG. 3 shows a section corresponding to FIG. 2, but in this case the spring element is in the active position.
Figure 4:
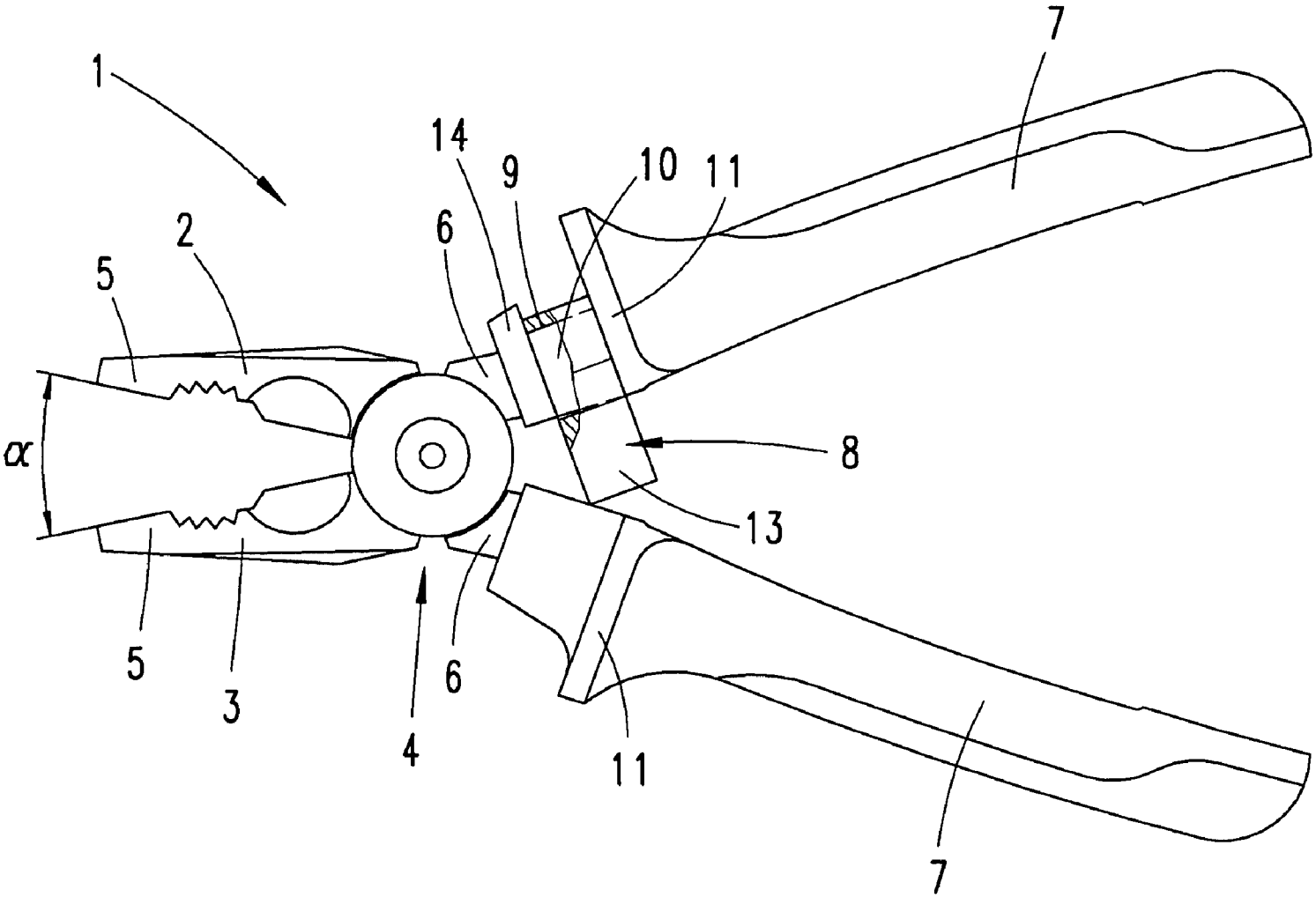
FIG. 4 shows a view corresponding to FIG. 1, but in this case the spring element is in the active position and butts against the handle enclosure located opposite, so that the hand tool is in an open position.
Figure 5:
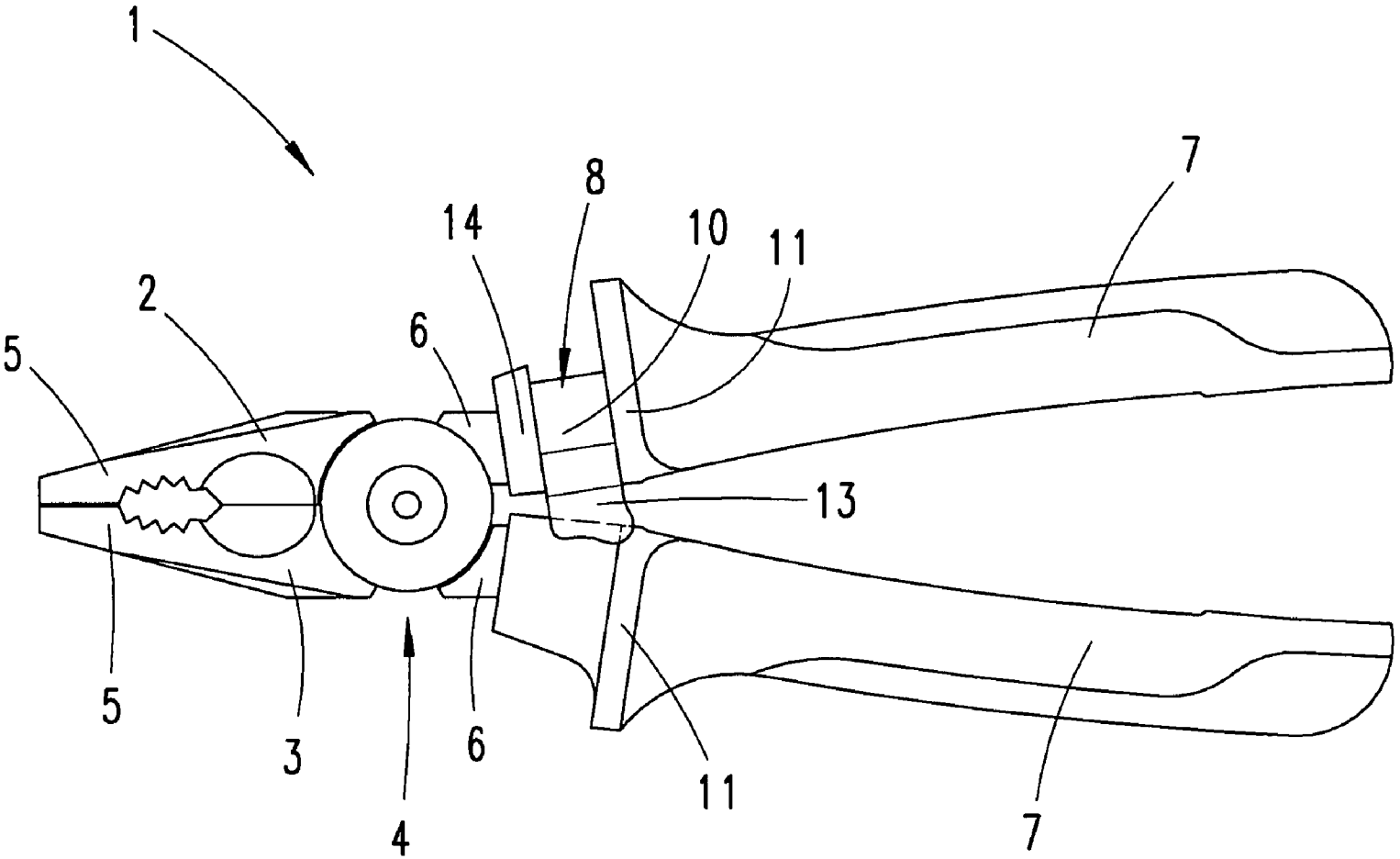
FIG. 5 shows a view corresponding to FIG. 4, but in this case the hand tool has been closed counter to the restoring force of the spring element.
Figure 8:
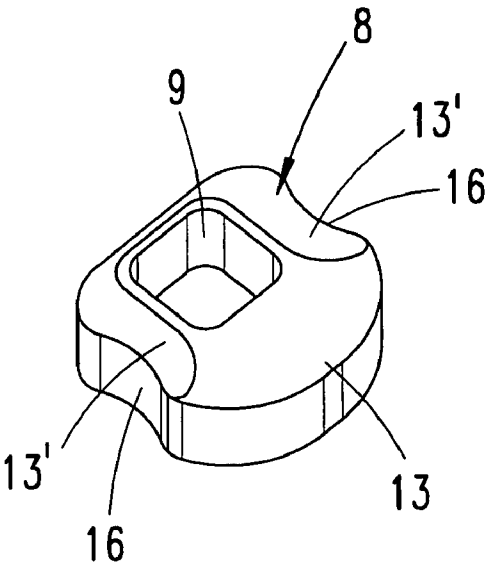
FIGS. 6-8 show perspective views of further possible configurations of the spring element.

In the (first) active position, which is illustrated in FIG. 3, the spring element 8 has been pivoted through 180° in relation to the illustration in FIGS. 1 and 2. The active region 13 of the spring element 8 now extends precisely opposite the protrusion of the supporting shoulder 11, this protrusion projecting beyond the rest of the handle. As can also be gathered from FIG. 4, the active region 13 is now disposed in the region between the handles 6. Starting from the largest possible opening angle of the pliers, the handle enclosure 7 located opposite comes into abutment against the active region 13 in the case of an opening angle $\alpha$ of approximately 24°. The action of pressing the tool halves 2, 3 further together is then therefore carried out counter to the elastic restoring force of the spring element 8. Once relieved of loading, the tool halves 2, 3 move automatically into the position which is illustrated in FIG. 4.

Furthermore, it is also possible for the spring element 8 to be pivoted, starting from the inactive position according to FIGS. 1 and 2, only through 90°. This gives rise to an active region 13', as is also indicated, in principle, for example in FIGS. 2 and 6 to 8. As can be seen, this achieves a different opening angle between the tool halves, from which the restoring force of the spring element 8 acts as the tool halves are pressed further together.

The different active regions 13' and 13 are created here by a different width (spacing from the periphery of the opening to the outer edge) of the spring element 8. However, it is also possible, in principle, for different active regions to be achieved in that, despite the same dimensions, that is to say also basically the same restoring force being established when the plier halves are released, different characteristics, for example different cavities 12, 15 in the spring element 8, give rise to different spring characteristics.

Figure 6:
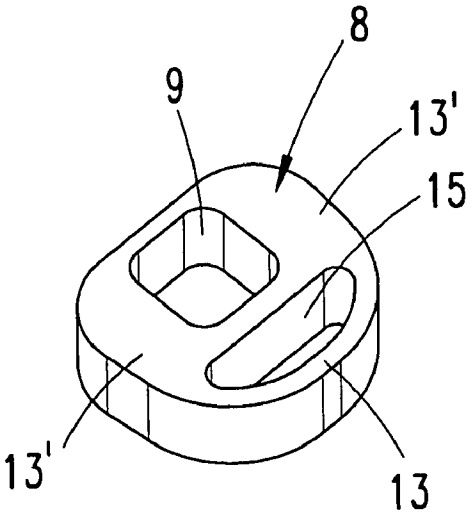
Figure 10:
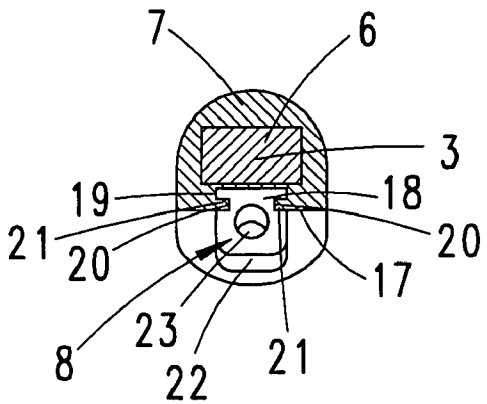
FIG. 10 shows a section along line X-X from FIG. 9.

FIG. 6 illustrates a further exemplary embodiment of the spring element 8. Here, the spring element 8 has just one, large cavity 15. The crosspieces between the individual cavities 12 of the spring element 8 in FIG. 2 have, as it were, been removed. This produces a large cavity 15. The spring force of the spring element 8 can be adjusted by the number and the shape of the cavities 12, 15.

Figure 7:
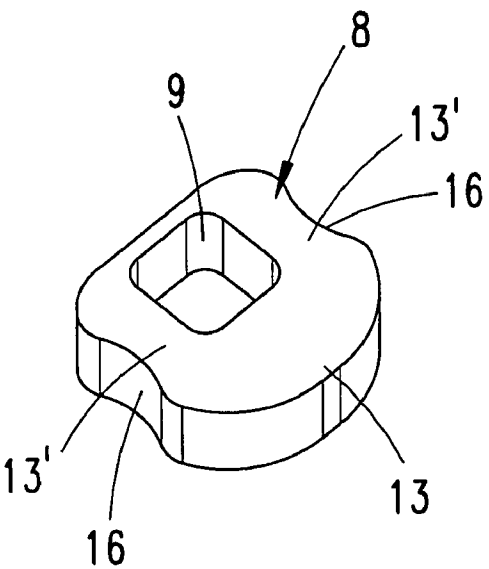

FIG. 7 illustrates a further exemplary embodiment of a spring element 8. This exemplary embodiment has no cavities, but grip hollows 16 are made in the broad sides of the active regions 13'. The grip hollows 16 give rise to a certain capacity for a positive grip for the purpose of the spring element 6 being pivoted by finger actuation. Those cavities which have been explained above may also be provided in the embodiments of FIGS. 7 and 8.

Furthermore, the spring element 8 may also consist of different (plastics) materials. In particular, it may be produced by two-component injection molding. In the exemplary embodiment of FIG. 8, the active regions 13' having the grip hollows 16 are produced from a harder material than the active region 13, but the region immediately surrounding the opening 9 is produced from a softer material than the regions of the grip hollows 16.

A further exemplary embodiment of a hand tool 1 will be described with respect to FIGS. 9 to 12. The hand tool 1 in FIGS. 9 to 12 is a side cutter. Reference numerals which have been used above will also be used for the same elements here.

In this exemplary embodiment, the spring element 8 is disposed on the inner side 17 of the handle enclosure 7. The spring element 8 has an elongate slide portion 18 which is guided in a longitudinal groove 19 of the handle enclosure 7. Here too, the spring element 8 is produced from an elastic rubber or plastics material. The slide portion 18 forms laterally running grooves 20, into which project guide rails 21 which are formed by the handle enclosure 7. The guide rails 21 extend from the periphery of the longitudinal groove 19 into the grooves 20 of the slide portion 18. The spring element 8 is thus retained in a positively fitting, but longitudinally displaceable, manner in the handle enclosure 7. The comparatively soft material, of which at least preferably the slide portion 18 consists, also allows straightforward fitting by clipping-in action. The longitudinal groove 19 extends approximately from halfway along the handle enclosure 7, in the direction of the joint 4, to just before the end of the handle enclosure 7. The spring element 8 can thus be displaced in the direction of the joint 4. As can be gathered from FIG. 10, the longitudinal groove 19 is made in the handle enclosure 7 to such an extent that the handle 6 is also fully enclosed by the handle enclosure 7 in the region of the longitudinal groove 19.

On the joint side, the spring element 8 forms an active portion 22 on the slide portion 18. The active portion 22 has an opening 23 passing through it. The axis of the opening 23 runs at an acute angle to the longitudinal extent of the longitudinal groove 19. The vertex of the acute angle here is oriented in the direction of the joint 4. As seen in the direction of those ends of the handles 6 to the rear of the active portion 22, the slide portion 18 forms a finger-supporting portion 24. The finger-supporting portion 24 is adapted to the width of the spring element 8.

Figure 9:
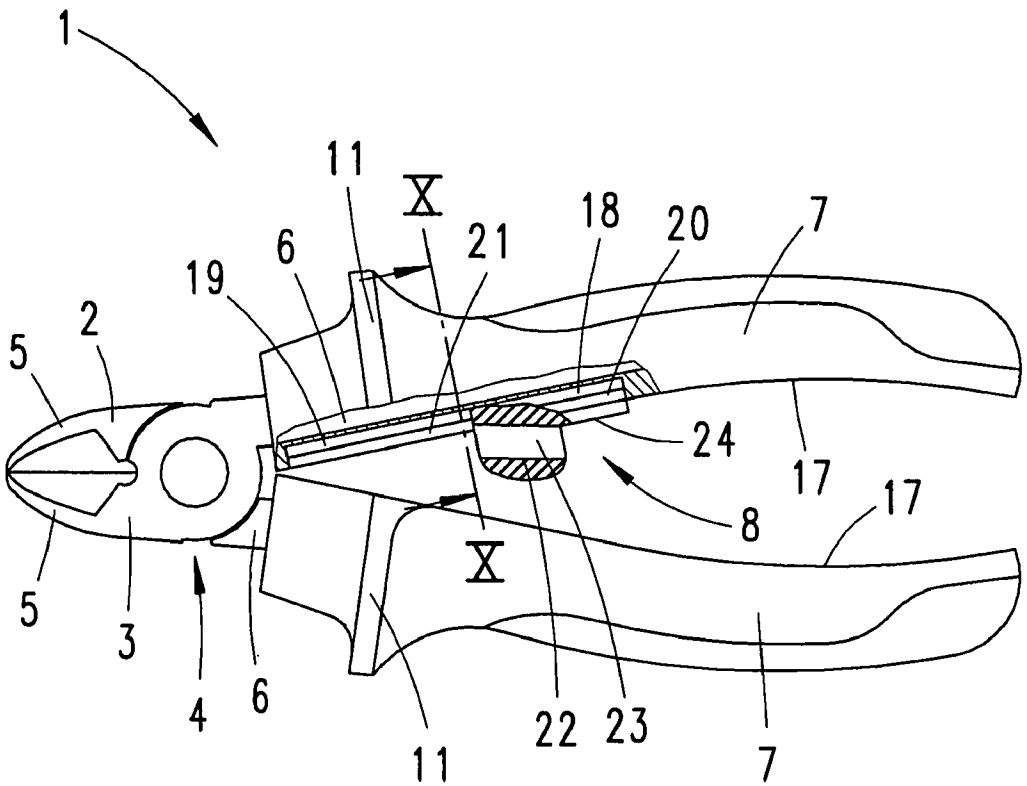
FIG. 9 shows a further exemplary embodiment of a hand tool in the form of a side cutter, the spring element being located in the inactive position and the hand tool being closed.
Figure 11:
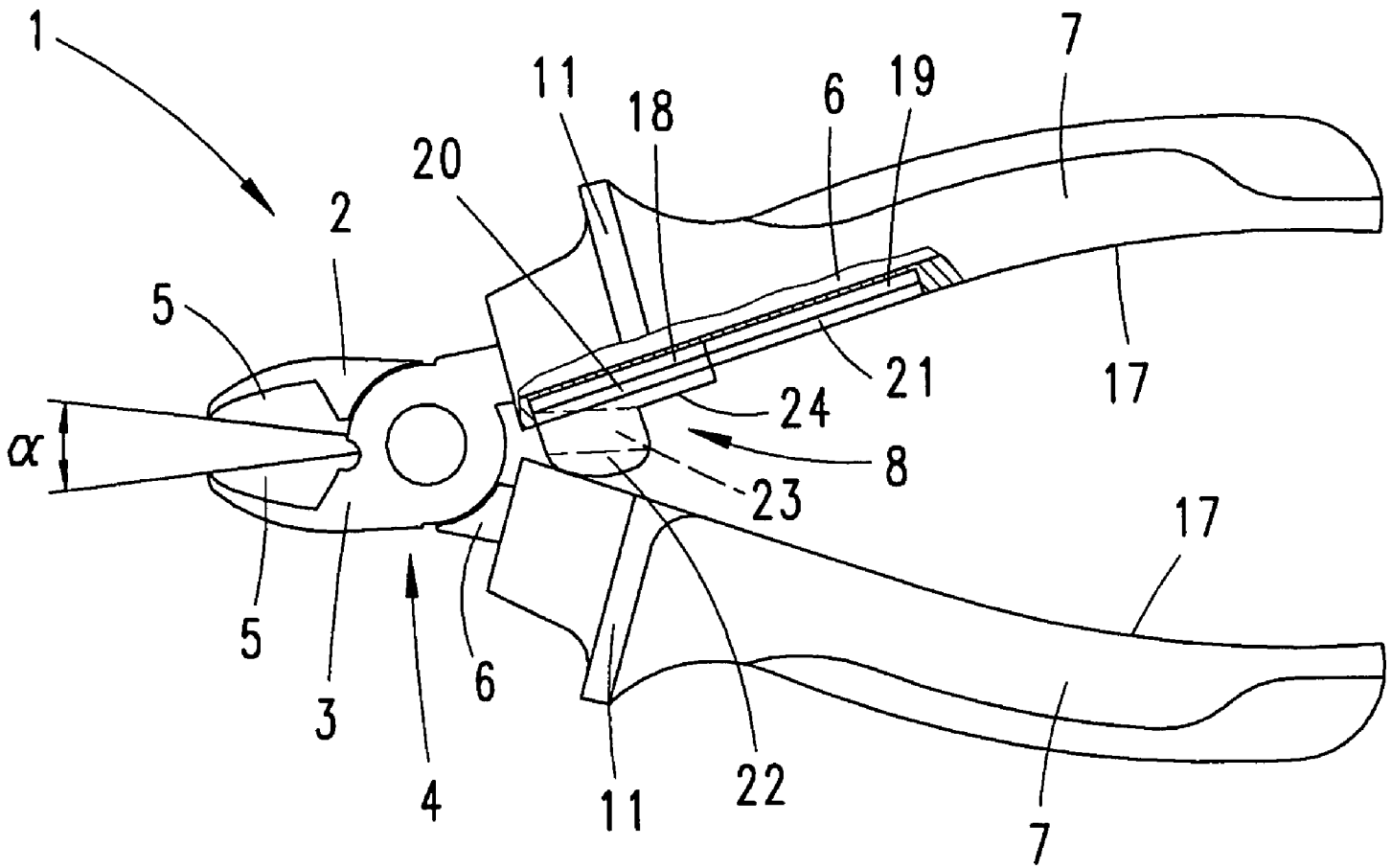
FIG. 11 shows a view corresponding to FIG. 9, but in this case the spring element has been displaced into the active position, as a result of which the hand tool has assumed an open position.
Figure 12:
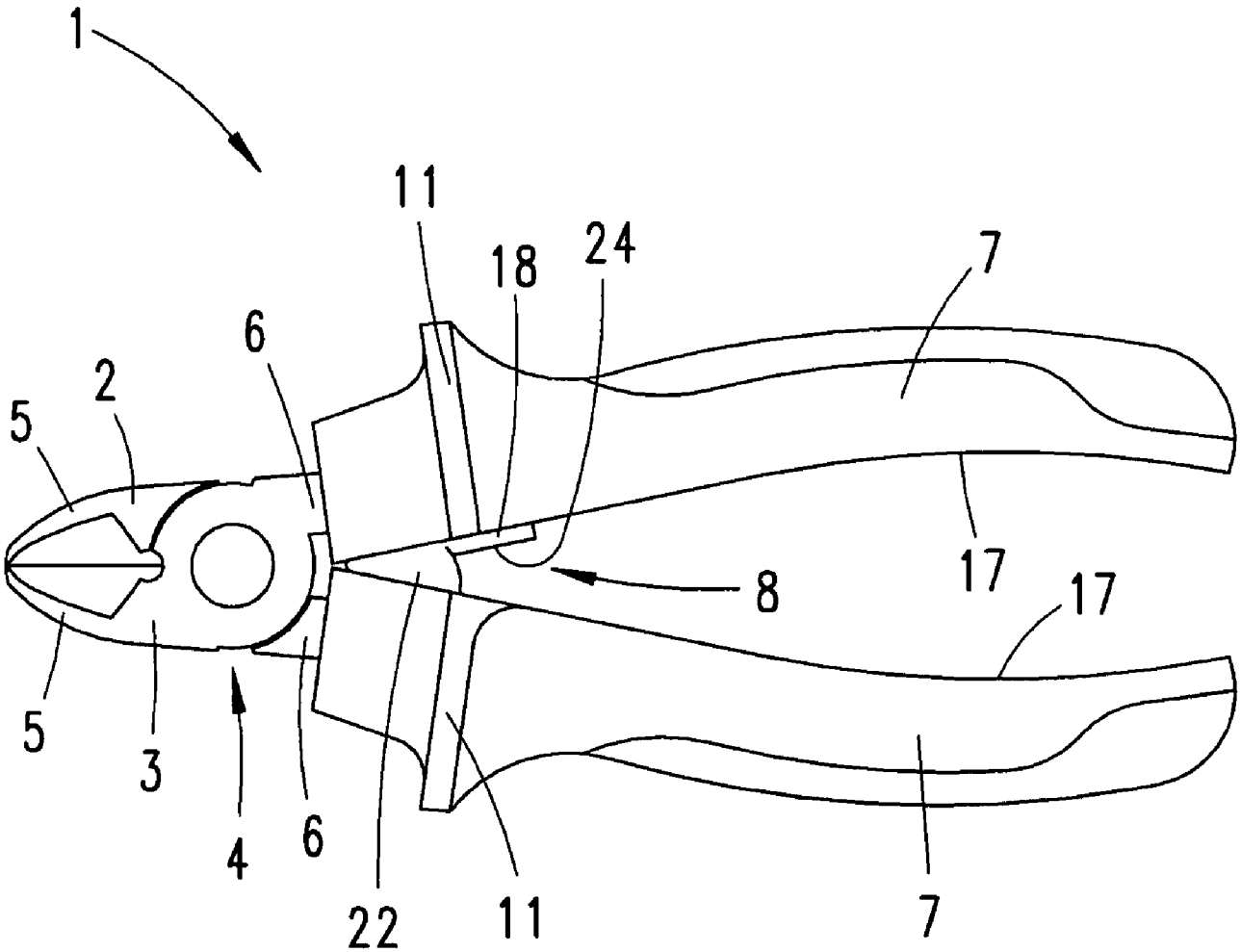
FIG. 12 shows a view corresponding to FIG. 11, but in this case the hand tool has been closed counter to the restoring force of the spring element.

If, starting from FIG. 9, the spring element 8 is then displaced within the longitudinal groove 19, in the direction of the joint 4, to the end, the spring element 8 is located in the active position, which is illustrated in FIG. 11. In this position, the active portion 22 butts against the inner side 17 of the handle enclosure 7 located opposite. The two handles 6 and the jaws 5 are thus spaced apart from one another. The hand tool 1 is retained in the open position. By virtue of the hand tool 1 being closed, the elastic active portion 22 of the spring element 8 is elastically deformed. If there is no longer any force being applied to the two handles 6 of the hand tool 1, the restoring force emanating from the elastic active portion 22 of the spring element 8 displaces the hand tool 1 back again into the open position, which is illustrated in FIG. 11. It is also the case with this exemplary embodiment that the opening 23 allows the spring element 8, in this case the active portion 22, to be more easily deformed. It is likewise also possible here for the opening angle $\alpha$ of the jaws 5 to be changed. This opening angle can be adjusted in a stepless manner by the position of the spring element 8 in relation to the joint 4. The closer the position of the spring element 8 to the joint 4, the greater is the opening angle $\alpha$.

All features disclosed are (in themselves) pertinent to the invention. The disclosure content of the associated/attached priority documents (copy of the prior application) is hereby also included in full in the disclosure of the application, also for the purpose of incorporating features of these documents in claims of the present application.

The invention claimed is:

1. Hand tool (1) having two tool halves (2, 3) which cross over at a joint (4), in particular a hand tool in the form of pliers, scissors or the like, it being the case that a tool half (2, 3) forms a jaw (5) on one side of the joint (4) and forms a handle (6) on the other side of the joint (4), and also that a spring element (8) is associated with one handle (6), the spring element comprising an elastic deformable rubber or plastics material and having an opening (9) through which the handle (6) passes, and it being the case that the spring element can be moved optionally, by rotation, out of an inactive position into at least one active position, in which active position the spring element (8), in dependence on the extent to which the handles (6) spread apart and on a corresponding restoring force being generated, comes into contact with the handle (6) located opposite, wherein the handle (6) is accommodated in a handle enclosure (7), and wherein a positive fit assists in an active position or inactive position of the spring element (8) being maintained.

2. Hand tool according to claim 1, wherein the handle enclosure (7) passes through the opening (9) in the spring element (8).

3. Hand tool according to claim 1, wherein at least one portion (10) of the handle (6) or of the handle enclosure (7) is of non-round configuration in cross-section.

4. Hand tool according to claim 1, wherein the opening (9) in the spring element (8) is cross-sectionally adapted in shape to the portion (10) of the handle (6) or of the handle enclosure (7).

5. Hand tool according to claim 1, wherein the spring element (8) is disposed on the joint side of a supporting shoulder (11) formed on the handle enclosure (7).

6. Hand tool according to claim 5, wherein the supporting shoulder (11) is adapted in shape to the outline of the spring element (8) in the inactive position.

7. Hand tool according to claim 5, wherein a shoulder (14) of the handle enclosure (7) is provided on the joint side of the spring element (8).

8. Hand tool according to claim 7, wherein the shoulder (14) has a smaller outline than the supporting shoulder (11).

9. Hand tool according to claim 1, wherein at least one cavity (12) is provided in the spring element (8).

10. Hand tool according to claim 1, wherein the spring element (8) comprises rubber or a thermoplastic elastomer.

11. Hand tool according to claim 1, wherein the spring element (8) comprises a number of materials of different degrees of hardness.

12. Hand tool according to claim 1, wherein the spring element (8) comprises externally a relatively hard material and internally a relatively soft material.

13. Hand tool according to claim 1, wherein the spring element (8) has grip hollows (16).

14. Hand tool according to claim 1, wherein the spring element (8) is produced by two-component injection molding.

15. Hand tool according to claim 1, wherein the extent of the opening (9) in the spring element (8) as seen in the direction of action of the spring element (8) is greater than the thickness of the spring element (8) along the axial extent of the handle (6).

16. Hand tool according to claim 1, wherein the spring element (8) is spaced apart from an outer contour of the joint (4).

17. Hand tool (1) having two tool halves (2, 3) which cross over at a joint (4), in particular a hand tool in the form of pliers, scissors or the like, it being the case that a tool half (2, 3) forms a jaw (5) on one side of the joint (4) and forms a handle (6), enclosed by a handle enclosure (7), on the other side of the joint (4), and also that a spring element (8) comprising an elastic deformable rubber or plastics material is associated with an inner side (17) of one handle enclosure, which spring element, by displacement towards the joint (4) in the direction of the longitudinal extent of the handle enclosure (7), can be moved from an inactive position, in which the spring element (8) is supported by the back of the handle (6), into at least one active position, in which active position the spring element (8), in dependence on the extent to which the handles (6) spread apart and on a corresponding restoring force being generated, comes into contact with the handle (6) located opposite, wherein even in the active position, the spring element (8) is supported in the active region by the back of the handle (6) or of the handle enclosure (7).

18. Hand tool according to claim 17, wherein the spring element (8) has a slide portion (18).

19. Hand tool according to claim 18, wherein the slide portion (18) has a width which corresponds to the thickness of the joint (4).

20. Hand tool according to claim 18, wherein the slide portion (18) forms a finger-supporting portion (24).

21. Hand tool according to claim 17, wherein the spring element (8) is not subjected to any deformation in the inactive position.

22. Hand tool according to claim 17, wherein the spring element (8) has an active portion (22) having an opening (23).

23. Hand tool according to claim 22, wherein the opening (23) is in the form of a through-opening.

24. Hand tool according to claim 22, wherein the active portion (22) comprises a softer material than the slide portion (18).

25. Hand tool according to claim 17, wherein in the region of the spring element (8), the handle enclosure (7) fully encloses the handle (6).

26. Hand tool (1) having two tool halves (2, 3) which cross over at a joint (4), in particular a hand tool in the form of pliers, scissors or the like, it being the case that a tool half (2, 3) forms a jaw (5) on one side of the joint (4) and forms a handle (6), enclosed by a handle enclosure (7), on the other side of the joint (4), and also that a spring element (8) comprising a number of materials of different degrees of hardness is associated with an inner side (17) of one handle enclosure, which spring element, by displacement towards the joint (4) in the direction of the longitudinal extent of the handle enclosure (7), can be moved from an inactive position, in which the spring element (8) is supported by the back of the handle (6), into at least one active position, in which active position the spring element (8), in dependence on the extent to which the handles (6) spread apart and on a corresponding restoring force being generated, comes into contact with the handle (6) located opposite, wherein even in the active position, the spring element (8) is supported in the active region by the back of the handle (6) or of the handle enclosure (7).

27. Hand tool (1) having two tool halves (2, 3) which cross over at a joint (4), in particular a hand tool in the form of pliers, scissors or the like, it being the case that a tool half (2, 3) forms a jaw (5) on one side of the joint (4) and forms a handle (6), enclosed by a handle enclosure (7), on the other side of the joint (4), and also that a spring element (8) produced by two-component injection molding is associated with an inner side (17) of one handle enclosure, which spring element, by displacement towards the joint (4) in the direction of the longitudinal extent of the handle enclosure (7), can be moved from an inactive position, in which the spring element (8) is supported by the back of the handle (6), into at least one active position, in which active position the spring element (8), in dependence on the extent to which the handles (6) spread apart and on a corresponding restoring force being generated, comes into contact with the handle (6) located opposite, wherein even in the active position, the spring element (8) is supported in the active region by the back of the handle (6) or of the handle enclosure (7).

* * * * *